US007004295B2

(12) United States Patent
Godshaw et al.

(10) Patent No.: US 7,004,295 B2
(45) **Date of Patent: *Feb. 28, 2006**

(54) WHEELED COMPUTER CASE

(75) Inventors: Donald E. Godshaw, Evanston, IL (US); Andrezj Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/927,334

(22) Filed: Aug. 26, 2004

(65) Prior Publication Data

US 2005/0023097 A1 Feb. 3, 2005

Related U.S. Application Data

(63) Continuation of application No. 10/784,349, filed on Feb. 23, 2004, which is a continuation of application No. 10/266,545, filed on Oct. 8, 2002, now Pat. No. 6,695,107, which is a continuation of application No. 09/697,546, filed on Oct. 26, 2000, now Pat. No. 6,460,668.

(60) Provisional application No. 60/161,550, filed on Oct. 26, 1999.

(51) Int. Cl.
*A45C 5/14* (2006.01)

(52) U.S. Cl. ..... 190/18 A; 190/18 R; 280/37

(58) Field of Classification Search ..... 190/18 R, 190/18 A, 115, 125, 127, 124, 24, 39; 280/37, 280/655, 655.1, 47.315; 16/114.1, 411
See application file for complete search history.

(56) References Cited

U.S. PATENT DOCUMENTS

| | | | | |
|---|---|---|---|---|
| 5,498,010 | A * | 3/1996 | Stube | 280/37 |
| 5,566,797 | A * | 10/1996 | Van Himbeeck | 190/18 A |
| 5,782,325 | A * | 7/1998 | O'Shea et al. | 190/18 A |
| 6,176,357 | B1 * | 1/2001 | Kuo | 190/18 A |
| 6,220,412 | B1 * | 4/2001 | Lin | 190/127 |
| 6,305,514 | B1 * | 10/2001 | Lin et al. | 190/115 |
| 6,695,107 | B1 * | 2/2004 | Godshaw et al. | 190/18 R |
| 6,702,164 | B1 * | 3/2004 | De Lathouwer | 224/153 |

* cited by examiner

*Primary Examiner*—Lien M. Ngo
(74) *Attorney, Agent, or Firm*—Banner & Witoff, Ltd.

(57) ABSTRACT

A case having a rectangular parallelepiped shape includes a rigid board inserted into a pocket defined in a lateral and bottom sides of the case. The board maintains the shape of the case in cooperation with wheel housings and a bracket attached to the bottom and lateral sides. A telescoping handle is also attached to the reinforcing board.

5 Claims, 4 Drawing Sheets

WHEELED COMPUTER CASE

CROSS REFERENCE TO RELATED APPLICATION

This utility application is a continuation application based upon a continuation application, Ser. No. 10/784,349 filed Feb. 23, 2004, now which is a continuation application Ser. No. 10/266,545, filed Oct. 8, 2002, now U.S. Pat. No. 6,695,107, which is a continuation of application Ser. No. 09/697,546, filed Oct. 26, 2000, now U.S. Pat. No. 6,460,668, which was based on a provisional application Ser. No. 60/161,550 that was filed Oct. 26, 1999 and for which priority is claimed.

BACKGROUND OF THE INVENTION

This invention relates to a wheeled computer case, and, more particularly, to a computer case which includes structural components that enable the case to have a generally fixed, rigid parallelepiped shape though comprised of sewn fabric material.

Luggage carrying cases and the like which include a telescoping handle and wheels are increasingly popular. Preferably, such cases have a parallelepiped shape with a framework or other means to maintain the case in a parallelepiped configuration. One difficulty with such constructions is the cost associated with manufacture and assembly. That is, a rigid assembly that maintains a desired configuration or shape tends to be more costly and more difficult to assemble than a sewn material case or container. An objective of the present invention is to provide a case or luggage item which is capable of including a telescoping handle and wheels and which may also be made from sewn material, but which is constructed in such a manner that its structural shape and integrity is maintained.

SUMMARY OF THE INVENTION

Briefly, the present invention comprises a packing case or luggage item having a rectangular, parallelepiped shape with a fabric sleeve defining a connected lateral side and bottom side of the case, the fabric sleeve including a rigid, L-shaped form board which is inserted into the sleeve or pocket defining the connected lateral side and bottom side. The board is cooperative with wheel wells and other elements to insure a rigid structure comprising a—parallelepiped case which includes a telescoping handle and wheels.

Thus, it is an object of the invention to provide an improved wheeled case construction.

It is a further object of the invention to provide an improved wheeled case construction which is comprised of fabric and which further includes a reinforcing board integrated into a pocket defined in two sides of the case.

Another object of the invention is to provide an improved personal computer case which includes a telescoping handle and wheels to facilitate ease of transport.

Another object of the invention is to provide an inexpensive, easily manufactured, rugged and highly useful carrying case for personal computers, files and the like.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
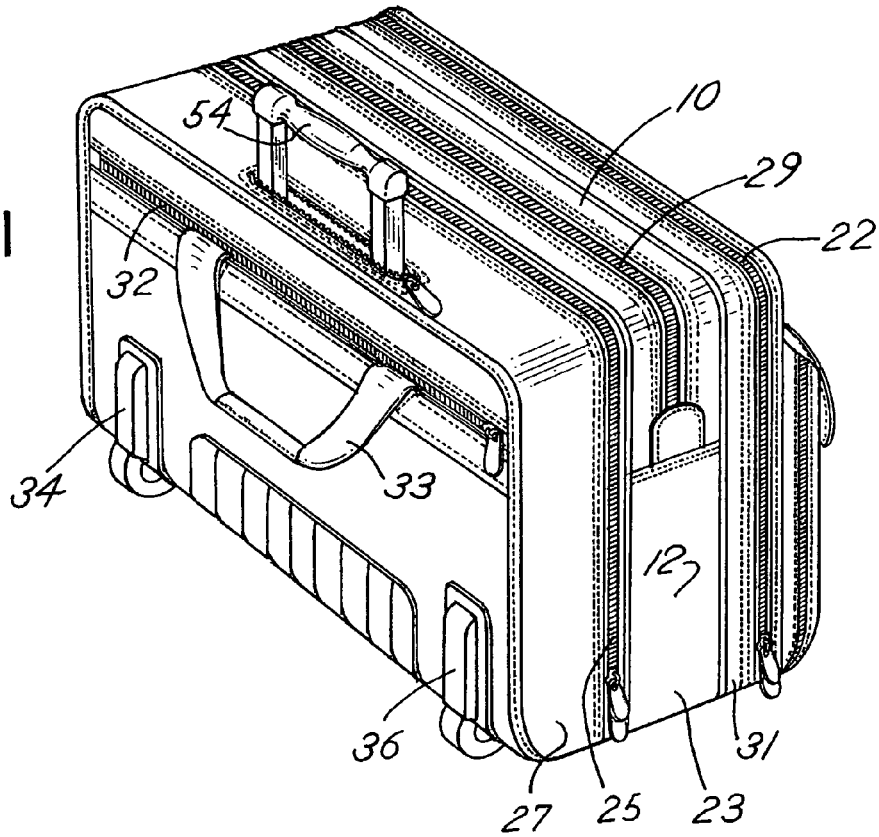
FIG. 1 is an isometric view of the case as viewed from the top side.
Figure 2:
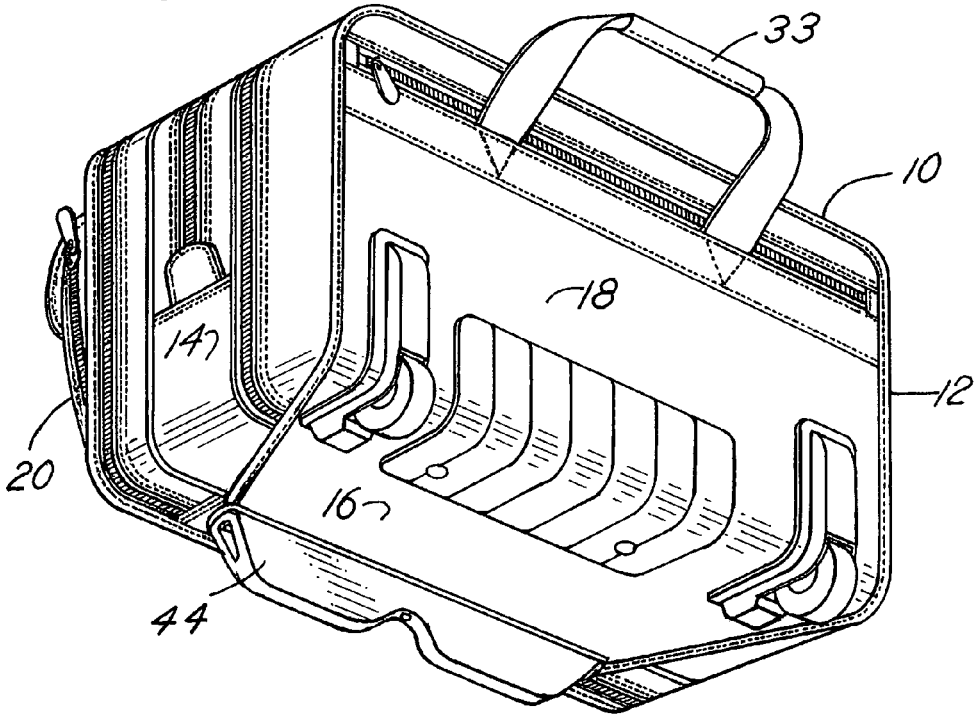
FIG. 2 is an isometric view of the case as viewed from the under side.

The case of the invention has a parallelepiped configuration as shown in the figures, especially FIGS. 1 and 2. The case is generally formed of sewn fabric material such as canvas, nylon or similar fabrics which are stitched to form the parallelepiped sides, zippered connections, etc of the case. The case thus includes a top side 10, a first end side 12, a second end side 14, a bottom side 16, a first lateral side 18 and a second lateral side 21. The sides 10, 12, 14, 16, 18, 21 are combined to form a generally parallelepiped case as depicted.

Figure 3:
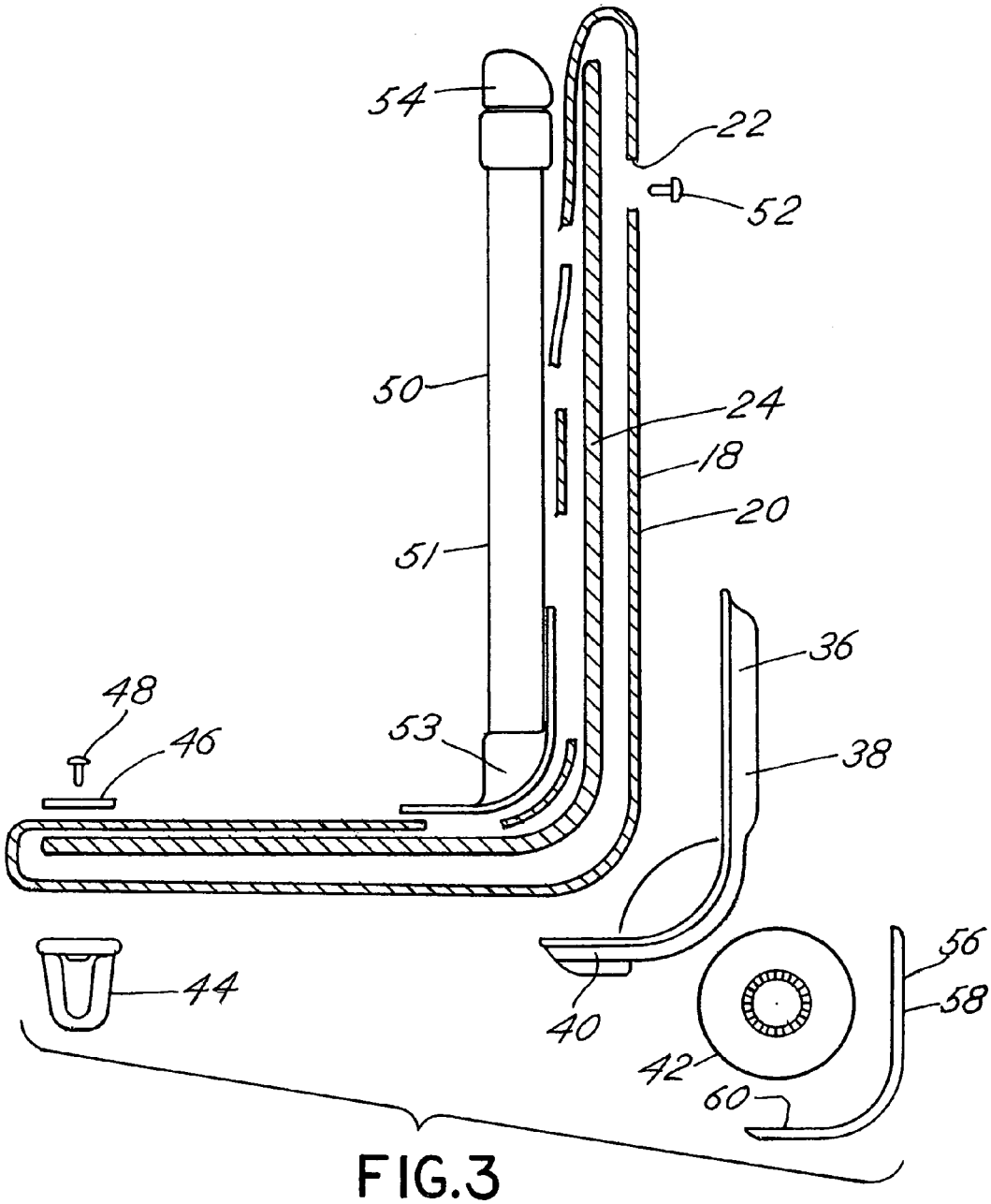
FIG. 3 is an exploded, cross sectional view of the case.
Figure 4:
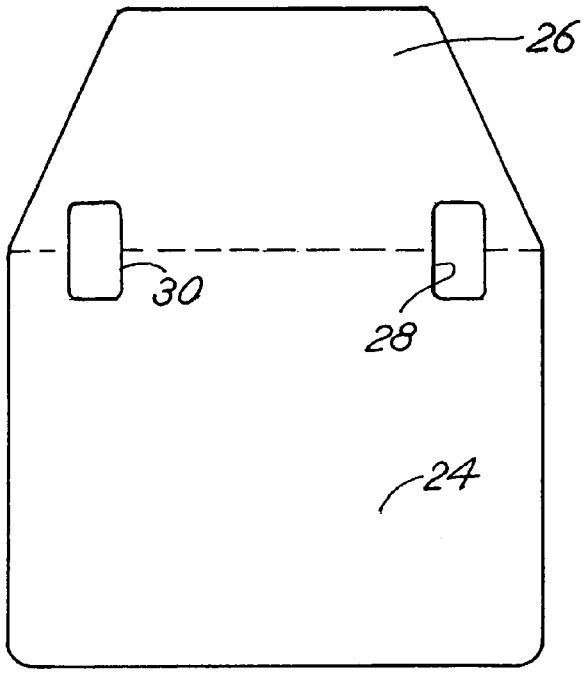
FIG. 4 is a plan view of the rigid board which is inserted into the fabric sleeve of the case.
Figure 5:
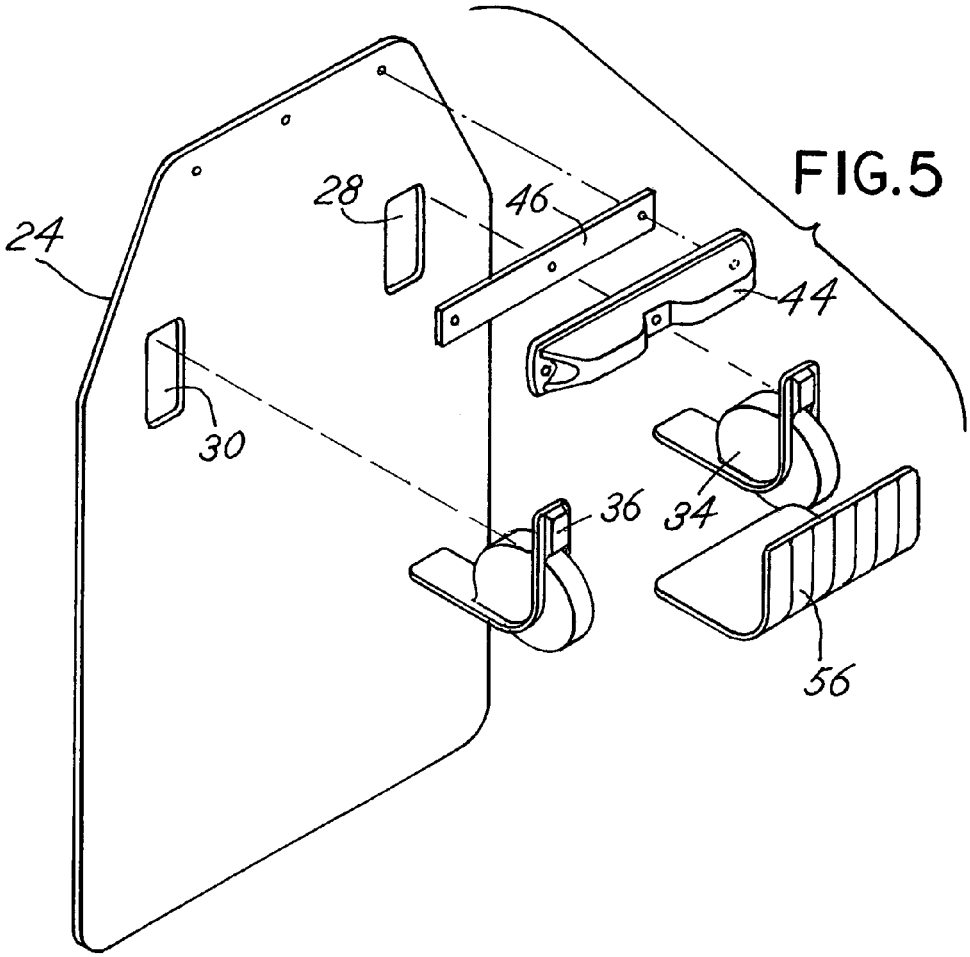
FIG. 5 is an exploded isometric view of the rigid board and foot of the case.
Figure 6:
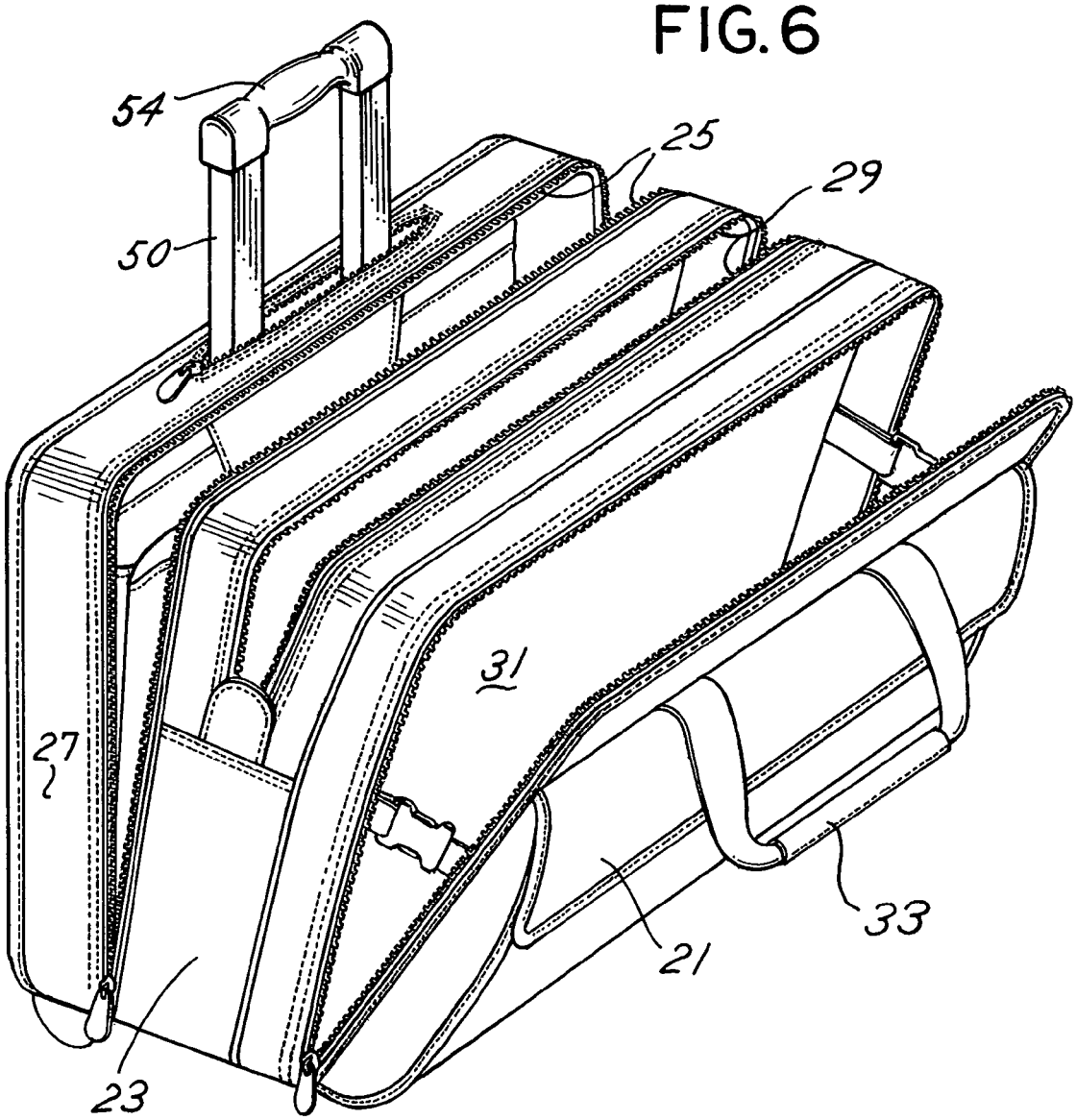
FIG. 6 is an isometric view of the case as viewed from the top side with the compartments open.

The first lateral side 18 and the bottom 16 have a special construction. That is, as depicted in the exploded cross sectional view of FIG. 3, the first lateral side 18 is comprised of a fabric pocket or sleeve 20 which has an open horizontal zippered slit or passage 22. Passage 22 may be on the inside or outside of the case. The sleeve 20 thus forms an enclosed pocket into which a rigid or generally rigid board 24 is inserted. The board 24 may be a polyethylene material board, for example, having a thickness of 5 mm, for example. The board 24 has a plan view configuration as depicted in FIG. 4. That is, the board 24 is generally rectangular with a tapered end 26 that forms part of the bottom side of the case as described below. Passages 28 and 30 are cut through the board 24 to receive a housing well for wheels. Referring again to FIG. 3, the board 24 is inserted into the sleeve 20 and retained therein by a zipper 32 during assembly. The board 24 is thus encapsulated within the sleeve 20.

A first wheel housing 34 and the second wheel housing 36 are attached to the sleeve 20 and board 24 by a means of fasteners or rivets which pass through the board 24 and engage the wheel housings 34, 36. Each wheel housing, e.g., housing, 36 has a first or vertical run 38 and a lower or horizontal run 40 defining an L-shape cross section and importing an L-shape cross section to the board 24. The wheel housing 36 when attached to board 24 thus helps shape and form the pocket 20 and board 24 into an L cross sectional shape, such as depicted in FIG. 3. A wheel 42 may thus be retained within each wheel pocket of the wheel housing 36.

A formed foot 44 is attached to the horizontal run of the board 24 and sleeve 20 by means of a retaining board 46 with rivets or fasteners 48. Attached to the inside of the board 24 and sleeve 20 is a telescoping handle assembly 50. The handle assembly 50 cooperates with the wheel housings 34, 36 and is fastened to the board 24 by means of fasteners, for example, fasteners 52. A telescoping handle 54, fits into hollow channels 51 of the handle assembly 50. The handle assembly 50 further includes lower brackets 53 which help shape board 24.

A forming bracket or outer handle housing 56 has an L shaped cross section with a vertical run 58 and a horizontal run 60. The bracket 56 cooperates with and is attached to the board 24 again by means of rivets or other fasteners. The outer handle housing 56 may also be riveted or attached to the lower end of the handle assembly 50. The bracket 56 further facilitates the retention of the shape of the fabric pocket 20 and the board 24 in the desired cross sectional configuration as depicted in FIG. 3.

The balance of the case is formed from flexible fabric material as described above and is sewn or attached to the sleeve 20. Thus, the case includes a front side or flap 21 retained by a zipper 22 which fastens the flap 21 to a front compartment 31. A center compartment 23 is, in turn, attached to the front compartment 31. Zipper 25 attaches the middle compartment 23 to an inside compartment 27. In practice, the inside compartment 27 may be designed to hold papers and folders and the like. The middle compartment 23 which has an access zipper 29 is adapted to define a pocket for receipt of a personal computer, for example. Forward or front compartment 31, which is defined by the space between the middle compartment 23, and the front flap 21 is also designed for holding papers and other materials. In this manner, a personal computer will be protected or retained within the internal, middle compartment 23 between compartments 27 and 31. The bottom side of the case having the rigid board 24 provided therein provides for further protection of the contents of the middle compartment 23. Fabric handles, such as handle 33, are also provided to permit ease of transport of the case.

The described construction thus provides that the entire case may be manufactured from rather flexible fabric material, but further provides that one lateral side and the bottom are reinforced by a rigid board which is shaped by brackets and wheel housings so as to maintain its L shaped cross section. This provides a means for making the case generally rigid and to facilitate maintaining the shape of the case. However, the case may be easily assembled using the described construction utilizing sewing techniques to sew all the component parts together.

What is claimed is:

1. A luggage item comprising, in combination:

a case having a generally rectangular parallelepiped shape, with a top side, a bottom side, first and second spaced end sides, and first and second spaced lateral sides;

an L shaped, generally rigid board member forming said first lateral side and said bottom side as a generally rigid form, said board member having an inside and outside;

a flexible fabric covering said outside of said board member on the first lateral side and bottom side and at least a portion of said inside of said board member on the first lateral side and the bottom side;

fabric forming the remaining sides of said case;

a support foot fastened to the rigid board member on the outside of the bottom side over the flexible fabric;

a telescoping handle extending vertically from the bottom side and fastened to the inside of the board member over the flexible fabric covering said first lateral inside;

an L shaped forming bracket fitted over flexible fabric covering on the outside of the board member and affixed to the board member on the first lateral side and the bottom side; and wheels mounted at the bottom side of the L shaped board member on the outside thereof.

2. The item of claim 1 further including first and second spaced wheels mounted to the board member at the juncture of the lateral side and bottom side.

3. The item of claim 2 wherein the second lateral side comprises a panel flexibly attached to the bottom side and detachable from the end sides and top side for access to the interior of the case.

4. The item of claim 2 wherein the board member includes precut slots to receive wheel housings, said slots located adjacent the juncture of the first lateral side and the bottom side.

5. The item of claim 2 wherein the interior of the case is divided into multiple compartments; with a center compartment open at the top side for receipt and storage of a personal computer.

* * * * *